United States Patent [19]

Tanaka et al.

[11] Patent Number: 4,981,837

[45] Date of Patent: Jan. 1, 1991

[54] HEAT-SENSITIVE TRANSFER MATERIAL

[75] Inventors: Mitsugu Tanaka; Seiiti Kubodera, both of Kanagawa, Japan

[73] Assignee: Fuji Photo Film Co., Ltd., Kanagawa, Japan

[21] Appl. No.: 318,871

[22] Filed: Mar. 6, 1989

[30] Foreign Application Priority Data

Mar. 4, 1988 [JP] Japan ..... 63-51285

[51] Int. Cl.[5] ..... B41M 5/35; B41M 5/26

[52] U.S. Cl. ..... 503/227; 8/471; 428/195; 428/484; 428/488.1; 428/913; 428/914

[58] Field of Search ..... 8/471; 428/195, 207, 428/913, 914, 484, 488.1, 488.4; 503/227

[56] References Cited

U.S. PATENT DOCUMENTS 4,032,691 6/1977 Kido et al. ..... 428/913
4,764,178 8/1988 Gregory et al. ..... 8/471

FOREIGN PATENT DOCUMENTS 2159971 12/1985 United Kingdom ..... 503/227

OTHER PUBLICATIONS

Patent Abstracts of Japan, vol. 10, No. 159 (M-486) [2215], Jun. 7, 1986.

*Primary Examiner*—Bruce H. Hess
*Attorney, Agent, or Firm*—Sughrue, Mion, Zinn, Macpeak & Seas

[57] ABSTRACT

A heat-sensitive transfer material comprising a support having thereon a coloring material layer comprising at least one dye represented by formula (I):

(I)

wherein $R_1$ represents a hydrogen atom, an alkyl group, an alkoxy group, an aryl group, an alkoxycarbonyl group, a cyano group or a carbamoyl group; $R_2$ represents a hydrogen atom, an alkyl group or an aryl group; $R_3$ represents an aryl group or a heterocyclic group; and $R_4$ and $R_5$, which may be the same or different, each represents a hydrogen atom or an alkyl group.

6 Claims, No Drawings

HEAT-SENSITIVE TRANSFER MATERIAL

FIELD OF THE INVENTION

This invention relates to heat-sensitive transfer materials.

BACKING OF THE INVENTION

At the present time, heat sensitive transfer methods, electrophotographic methods, ink jet methods, etc., are investigated vigorously as techniques for providing colored hard-copy. The heat-sensitive transfer method has many advantages over the other systems, being simple in terms of the maintenance and operation of the equipment, and the equipment and consumables are also inexpensive.

The heat-sensitive transfer systems include a system in which a heat-sensitive transfer material which has a heat-sensitive fusible ink layer on a base film is heated with a thermal head, the ink is fused, and a recording is made on a copy sheet (recording material). Further, a system is also included in which a heat-sensitive transfer material, in which a coloring material layer containing a sublimable dye is formed on a base film (support), is heated with a thermal head, and the dye is sublimed and transferred onto a copy sheet. With the sublimation transfer system, the amount of dye transferred can be altered by changing the energy which is supplied to the thermal head and so graded recordings can be achieved easily. This is advantageous for providing high quality full color recordings.

However, various limitations apply to the sublimable dyes used in such a system and there are very few dyes which satisfy all of the requirements of such dyes.

Examples of some of the requirements of these dyes include having the preferred spectral characteristics for color reproduction, being easily sublimed, being resistant to light and heat, being resistant to a variety of chemicals being easily prepared, and being such that the heat sensitive transfer materials can be prepared easily. The development of sublimable yellow dyes which have excellent spectral characteristics and which are very light fast (resistant) is especially desirable.

Various yellow dyes have been suggested for heat sensitive transfer purposes, e.g., in JP-A-59-78895, JP-A-60-28451, JP-A-60-28453, JP-A-61-148096, JP-A-60-27594, JP-A-60-152563, JP-A-61-244595 and JP-A-61-262191 (The term "JP-A" as used herein means an "unexamined published Japanese patent application"). However, none of these dyes provide both spectral characteristics which have a good sharp absorbance and a high order of light fastness.

SUMMARY OF THE INVENTION

An object of the present invention is to provide a heat-sensitive transfer material which contains yellow dyes which have spectral characteristics that display a good sharp absorption, and which have a high order of light fastness.

Other objects and effects of the present invention will be apparent from the following description.

The objects of the present invention as indicated above have been realized by means of a heat-sensitive transfer material comprising a support having thereon a coloring material layer containing at least one dye represented by formula (I):

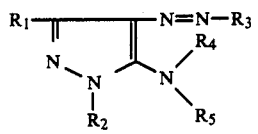

(I)

wherein $R_1$ represents a hydrogen atom, an alkyl group, an alkoxy group, an aryl group, an alkoxycarbonyl group, a cyano group or a carbamoyl group; $R_2$ represents a hydrogen atom, an alkyl group or an aryl group; $R_3$ represents an aryl group or a heterocyclic group; and $R_4$ and $R_5$, which may be the same or different, each represents a hydrogen atom or an alkyl group.

Each of the above mentioned substituent groups may be substituted with further substituent groups.

DETAILED DESCRIPTION OF THE INVENTION

Formula (I) is described in detail below.

$R_1$ preferably represents a hydrogen atom, an alkyl group (which has from 1 to 12 carbon atoms, for example, methyl, ethyl, iso-propyl, butyl, methoxyethyl), an alkoxy group (which has from 1 to 12 carbon atoms, for example, methoxy, ethoxy, iso-propoxy, methoxyethoxy), an aryl group (which has from 6 to 15 carbon atoms, for example, phenyl, p-tolyl, p-methoxyphenol, p-chlorophenyl, o-methoxyphenyl), an alkoxycarbonyl group (which has from 2 to 12 carbon atoms, for example, methoxycarbonyl, ethoxycarbonyl, butoxycarbonyl), a cyano group or a carbamoyl group (which has from 1 to 12 carbon atoms, for example, methylcarbamoyl, dimethylcarbamoyl, butylcarbamoyl, phenylcarbamoyl).

Of these groups, an alkyl group having from 1 to 4 carbon atoms are more preferred as $R_1$.

$R_2$ preferably represents a hydrogen atom, an alkyl group (which has from 1 to 12 carbon atoms, for example, methyl, ethyl, iso-propyl, butyl, methoxyethyl, cyanoethyl), or an aryl group (which has from 6 to 25 carbon atoms, for example, phenyl, p-tolyl, p-methoxyphenyl, p-chlorophenyl, o-methoxyphenyl).

Of these groups, a methyl group and a phenyl group are more preferred as $R_2$.

$R_3$ preferably represents an aryl group (which has from 6 to 25 carbon atoms, for example phenyl,

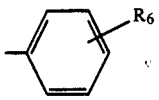

(where $R_6$ represents at least one substituent group (for example, an alkyl group, an alkoxy group, an aryloxy group, an aralkyl group, an aryl group, a halogen atom, a cyano group, a nitro group, an ester group, a carbamoyl group, an acyl group, an acylamino group, a sulfonyl group, a sulfamoyl group, a sulfonamido group, an amino group, an alkylamino group, an arylamino group, a hydroxyl group, etc.)) or a heterocyclic group (which has from 3 to 12 carbon atoms, for example, imidazolyl, pyridyl, pyrazolyl, thiazolyl, benzimidazolyl, quinolyl, benzopyrazolyl, benzothiazolyl, isothiazolyl, benzoisothiazolyl, pyridoisothiazolyl, and one or more of the hydrogen atoms on the ring of these groups may be replaced with a substituent group, for example, an alkyl group, an alkoxy group, an aryloxy group, an aralkyl group, an aryl group, a halogen atom, a cyano group, a nitro group, an ester group, a carbamoyl group, an acyl group, an acylamino group, a sulfonyl group, a sulfamoyl group, a sulfonamido group, an amino group, an alkylamino group, an arylamino group or a hydroxyl group)).

Of these groups, a phenyl group substituted with from 1 to 3 electron attractive groups (for example, a halogen atom, a cyano group, a nitro group, a carbamoyl group, an acryl group, a sulfonyl group, a sulfamoyl group) are more preferred as $R_3$.

$R_4$ and $R_5$, which may be the same or different, represents a hydrogen atom or an alkyl group (which has from 1 to 12 carbon atoms, for example, methyl, ethyl, iso-propyl, butyl, methoxyethyl).

Of these groups, a hydrogen atom is more preferred as $R_4$ and $R_5$.

Actual examples of dyes which can be represented by formula (I) and which can be used in the present invention are indicated below. The present invention is not, however, construed as being limited to these examples.

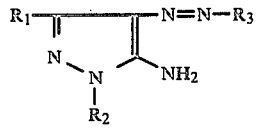

| Compound No. | $R_1$ | $R_2$ | $R_3$ |
|---|---|---|---|
| 1 | $-CH_3$ | 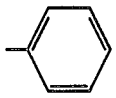 | 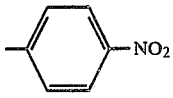 |
| 2 | " | " | 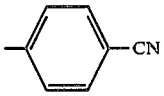 |
| 3 | " | " | 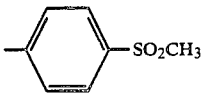 |
| 4 | " | " | 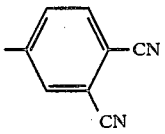 |
| 5 | " | " | 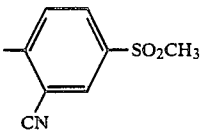 |
| 6 | " | " | 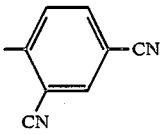 |
| 7 | " | " | 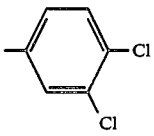 |
| 8 | " | " | 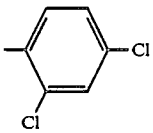 |

-continued
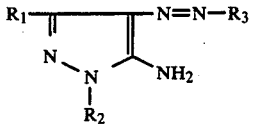
| Compound No. | $R_1$ | $R_2$ | $R_3$ |
|---|---|---|---|
| 9 | $-CH_3$ | 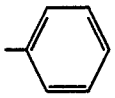 | 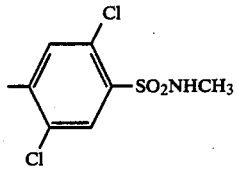  |
| 10 | " | " | 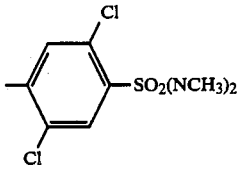  |
| 11 | " | " | 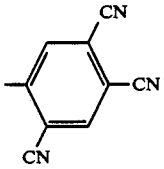  |
| 12 | " | " | 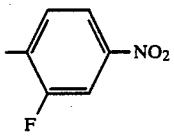  |
| 13 | " | " | 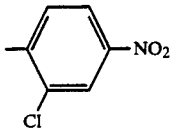  |
| 14 | " | " | 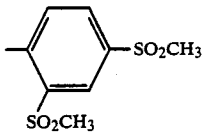  |
| 15 | " | " | 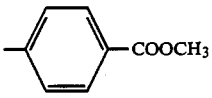  |
| 16 | $-CH_3$ | 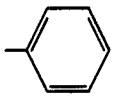 | 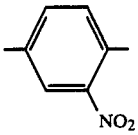  |
| 17 | $-C_2H_5$ | 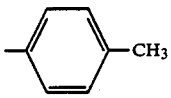  | 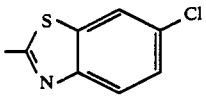  |

-continued
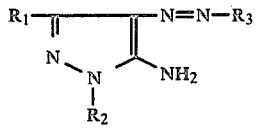
| Compound No. | $R_1$ | $R_2$ | $R_3$ |
|---|---|---|---|
| 18 | 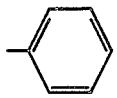 | 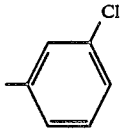 | 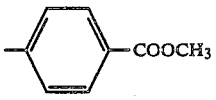 |
| 19 | " | $-CH_3$ | 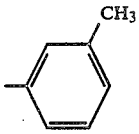 |
| 20 | $-COOC_2H_5$ | $-CH_2CH_2CN$ | 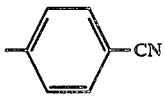 |
| 21 | $-COOC_2H_5$ | 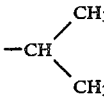 | 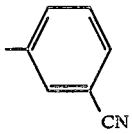 |
| 22 | " | 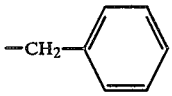 | 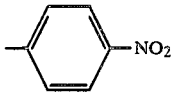 |
| 23 | $-CH_3$ | 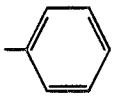 | 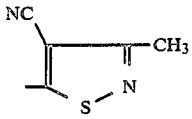 |
| 24 | 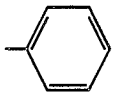 | 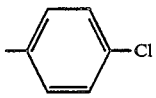 | 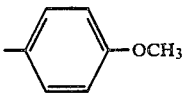 |
| 25 | $-OCH_3$ | 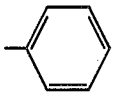 | 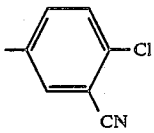 |
| 26 | $-OC_2H_5$ | 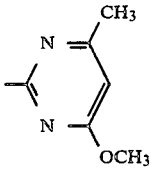 | 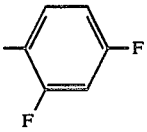 |
| 27 | $-C_4H_9(t)$ | 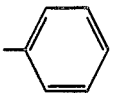 | 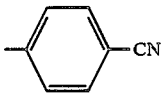 |

Among the above compounds, Compound Nos. 1, 4, 7, 9, 12 and 22 are preferably used in the present invention.

The compounds used in the invention can be obtained by diazotizing compounds represented by $R_3$—$NH_2$ and coupling the diazonium salts thus obtained with compounds represented by the following formula.

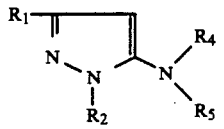

An Example of synthesis is described below.

SYNTHESIS EXAMPLE

Preparation of Compound No. 1

A mixture consisting of 1.6 g of p-nitroanline, 20 ml of water and 2.9 ml of concentrated hydrochloric acid were stirred on a ice bath. 0.8 g of sodium nitride were added to the above mixture while maintaining the temperature within the range of from 0° to 5° C. The diazonium salt solution obtained on stirring the mixture for 30 minutes was added dropwise at a temperature of less than 5° C. into a mixture of 2.0 g of 5-amino-1-phenyl-3methylpyrazole, 50 ml of methanol and 5.7 g of sodium acetate. The crystals which formed were recovered by filtration and washed with methanol. Recovery 3.3 g, melting point 155° to 156° C.

The heat-sensitive transfer materials of this invention are distinguished chiefly by the use of specified dyes as described above. In a first embodiment of this invention, the heat-sensitive transfer layer which contains the above-described dye (coloring material layer) is a heat-sensitive sublimation transfer layer comprising the dye represented by formula (I) (thermally transferable dye) and a binder resin. The heat-sensitive transfer material of this invention in this embodiment is obtained by preparing a coating composition (ink) by dissolving or dispersing the dye of this invention and a binder resin in a suitable solvent, coating the composition onto one side of a support in an amount, for example, sufficient to provide a dry film thickness of, generally from 0.2 to 5.0 μm, and preferably from 0.4 to 2.0 μm, and drying the coating to provide a heat-sensitive transfer layer.

Furthermore, any of the conventional binder resins known for this purpose can be employed as the binder resin which is used together with the dyes of this invention, and a binder resin which is highly resistant to heat and which does not impede the transfer of the dye when heated can be selected. Examples of the binder resins which can be used for this purpose include polyamide resins, polyester resins, epoxy resins, polyurethane resins, polyacrylic resins (for example, poly(methyl methacrylate), polyacrylamide), vinyl resins (for example, polyvinylacetal, polyvinylpyrrolidone), poly(vinyl chloride) resins (for example vinyl chloride/vinyl acetate copolymers), polycarbonate resins, polysulfones, polyphenyleneoxides, cellulose resins (for example, methylcellulose, ethylcellulose, carboxymethylcellulose, cellulose acetate hydrophthalate, cellulose acetate, cellulose acetate propionate, cellulose acetate butyrate, cellulose acetate), poly(vinyl alcohol) resins (for example, poly(vinyl alcohol), partially saponified poly(vinyl butyral)), petroleum based resins, rosin derivatives, coumarone-indene resins, starch based resins, novolak type phenol resins, polystyrene resins and polyolefin resins (for example, polyethylene, polypropylene).

Among the above binder resins, polyester resins, polycarbonate resins, polysulfones, cellulose resins and poly(vinyl alcohol) resins are preferred, and polycarbonate resins, cellulose resins and poly(vinyl alcohol) resins are more preferred.

These binder resins are preferably used, for example, in an amount ranging from about 80 to 600 parts by weight per 100 parts by weight of the dye.

The conventional ink solvents can be used freely as the ink solvent for dissolving or dispersing the above mentioned dye and binder resin used in this invention, and actual examples of such solvents include water, alcohols such as methanol, ethanol, iso-propyl alcohol, butanol and iso-butanol, esters such as ethyl acetate and butyl acetate, ketones such as methyl ethyl ketone, methyl isobutyl ketone and cyclohexanone, halogen based solvents such as dichloromethane, trichloroethane and chloroform, N,N-dimethylformamide, N-methylpyrrolidone, dioxane, tetrahydrofuran, cellosolves such as methyl cellosolve and ethyl cellosolve, or mixtures of these solvents. These solvents must be selected and used in such a way that the above mentioned dye which is used is dissolved or dispersed at least at the prescribed concentration and the aforementioned binder resin is dissolved or dispersed adequately. For example, the use of an amount of solvent from about 9 to 20 times the total weight of the aforementioned dye and binder resin is preferred.

The dyes used in the present invention may be used individually, or mixtures of two or more types may be used. Furthermore, the dyes which are used may be mixed with known dyes.

Known anti-color fading agents can also be used jointly with the dyes used in this invention.

Any of the conventional supports, provided that they have a certain amount of heat resistance and strength resistant to heat transfer recording, can be used as the support which is used in the construction of a heat-sensitive transfer material of this invention. For example, papers, various synthetic papers, polyesters (for example, polyethyleneterephthalate), polyamides, polycarbonates, glassine papers, condenser paper, cellulose esters, polyacetals, polyolefins, polyphenylenesulfides, polypropylenes, polysulfones, allophanes and polyimides can be used. The use of polyester film is especially preferred. The thickness of the support is preferably from 0.5 to 50 μm, and more preferably from 3 to 10 μm.

A reverse roll coater, a gravure coater, a rod coater or an air doctor coater can be used, for example, for coating the ink on the base film.

The heat-sensitive transfer materials according to this invention can be used satisfactorily without further treatment, but an anti-stick layer, i.e., a release layer, may be established on the surface of the heat-sensitive transfer layer. As a result of the establishment of such a layer, it is possible to prevent the sticking together of the heat-sensitive transfer material and the recording material during heat transfer and, moreover, it is possible to use higher heat transfer temperatures and to form excellent images of higher density.

The simple attachment of anti-stick inorganic powder (such as silica, clay, talc, diatomaceous earth, calcium carbonate, calcium sulfate, aluminum silicate, synthetic zeolite, zinc oxide, lithopone, titanium oxide and alumina) has a certain effect as a release layer, or a release layer can be formed by establishing a layer having a thickness of from 0.01 to 5 μm, and preferably from 0.05 to 2 μm, comprising a resin which has excellent release properties, such as a silicone polymer, an acrylic polymer or a fluorine based polymer.

Moreover, an inorganic powder or release type polymer as described above can also be effective when included in the heat-sensitive transfer layer.

Furthermore, a heat resistant layer may be established on the surface of the heat-sensitive transfer material of this invention in order to prevent any adverse effects from arising because of the thermal head.

A dye barrier layer comprising a hydrophilic polymer may also be established between the support and the heat-sensitive transfer layer and the transfer density of the dye can be improved in this way.

A preferred embodiment of a heat-sensitive transfer material of this invention obtained in the way described above is mounted on a conventional recording material and, by heating from either side, but preferably from the heat-sensitive transfer material side, with a heating device such as a thermal head, for example, in accordance with an image signal. The dye in the heat-sensitive transfer layer is easily transferred to the dye receiving layer of the recording material with comparatively low energies and in accordance with the magnitude of the thermal energy to form a hard-copy, and thus a colored image which has excellent brightness, resolution and gradation can be obtained.

The dyes used in the present invention can also be used in heat-sensitive transfer materials other than those involving a sublimation transfer materials. That is, a second preferred embodiment of the present invention is an embodiment in which the heat-sensitive transfer layer of the heat-sensitive transfer material is a heat-sensitive fusible transfer layer which comprises a dye of this invention and a wax. A heat-sensitive transfer material of this embodiment is obtained by preparing a heat-sensitive transfer layer forming composition (ink) comprising a wax which contains a dye of this invention and forming a heat-sensitive fusible transfer layer by coating this ink on one surface of a support. The ink is obtained by compounding or dispersing the dye in a wax, for example paraffin wax, microcrystalline wax, carnauba wax or urethane based wax, which has a suitable fusion point, e.g., from 30° to 110° C. The proportions of dye and wax used are such that the amount of dye is from 10 to 65 wt % based on the weight of the heat-sensitive fusible transfer layer, and the thickness of the layer is preferably from about 1.5 to 6.0 μm. Known techniques (as described, e.g., in JP-A-64-24791) can be used for the preparation of such a material and for the application of the ink to the support.

The supports, additives and the additional layers for the above first embodiment of this invention can also be used in the second embodiment of this invention.

The second preferred embodiment of the heat-sensitive transfer material of this invention is used in the same way as the first embodiment, whereupon the heat-sensitive fusible transfer layer is transferred to the recording material and excellent printing can be obtained.

The dyes represented by formula (I) of this invention have a bright yellow color and so they are suitable for providing full color records with good color reproduction when combined with suitable cyan dyes and magenta dyes. Furthermore, the dyes are easily sublimed and they have a large molecular extinction coefficient. Thus, records which have a high color density can be obtained quickly without imposing a large burden on the thermal head. Moreover, the dyes are stable with respect to heat, light, moisture, chemicals, etc. Thus, there is no thermal degradation during transfer recording and the record obtained has excellent storage properties. Furthermore, the dyes of this invention have good solubility in organic solvents and dispersion properties in water. Therefore, it is easy to prepare inks of high concentrations with uniform solution or dispersion, and it is possible by using these inks to obtain transfer materials on which the dye has been coated uniformly and at a high concentration. Hence, it is possible, by using these transfer materials, to obtain record which have excellent uniformity and color density.

The present invention will be described in more detail by referring to the following examples, but is nor construed as being limited thereto.

The manufacture of heat-sensitive transfer materials and recording materials, printing in which both materials are used, and evaluation of the recorded image were carried out as follows.

EXAMPLE 1

Preparation of the Heat-sensitive Transfer Material (1)

A 6 μm thick polyethyleneterephthalate film (S-PET, made by Toyobo Co., Ltd.) which had been subjected to a coronal discharge treatment on one side was used as a support. A heat-sensitive transfer layer coating composition of which the composition is indicated below was coated with a wire bar coater to form a layer of dry thickness 1 μm on the surface of the support which had been subjected to the coronal discharge. The other surface was covered with a tetrahydrofulan solution of a slipping layer containing poly(vinyl stearate) (0.3 g/m$^2$) in poly(vinyl butyrate) ("Butoparl-76" ®, made by Monsanto) (0.45 g/m$^2$), and then dried.

| Heat-sensitive Transfer Layer Coating Composition (1) | |
|---|---|
| Dye (Compound No. 1) | 4 g |
| Poly(vinyl butyrate) resin (made by Denki Kagaku Kogyo K. K., "Denka butyral 5000-A") | 4 g |
| Toluene | 40 ml |
| Methyl ethyl ketone | 40 ml |
| Polyisocyanate (made by Takeda Chemical Industries Co., Ltd. "Takenate D110N") | 0.2 ml |

Heat-sensitive transfer materials (2) to (9), and comparative materials (a) and (b), were prepared by replacing the dye mentioned above with other dyes shown in Table 1.

Preparation of the Recording Material

Synthetic paper (made by Oji Yuka Co., Ltd., "YUPO-FPG-150") of thickness 150 μm was used as the support. The receiving layer coating composition (1) of which the composition is indicated below was coated by wire bar coating so as to provide a dry film thickness of 10 μm on the surface of the support to provide the recording material (1). The material so obtained was dried with a drier and then heated to 100° C. in an oven for a period of 30 minutes.

| Receiving Layer Coating Composition (1) | |
|---|---|
| Polyester resin (made by Bayer, "APEC KLI-9306") | 20 g |
| Amino modified silicone oil (made by Shin-Etsu Silicone Co., Ltd., "KF-857") | 0.5 g |

-continued

| Receiving Layer Coating Composition (1) | |
|---|---|
| Epoxy modified silicone oil (made by Shin-Etsu Silicone Co., Ltd., "KF-100T") | 0.5 g |
| Dibutyl phthalate | 2 ml |
| Methyl ethyl ketone | 85 ml |
| Toluene | 85 ml |
| Cyclohexanone | 30 ml |

The heat-sensitive transfer materials and the recording material obtained in the way described above were superimposed in such a manner that the thermal transfer layer and the receiving layer were in contact with each other, and printing was carried out from the support side of the heat-sensitive transfer materials using a thermal head under conditions of a thermal head output of 1 W per dot, a pulse width of 0.3 to 0.45 msec and with a dot density of 6 dots per millimeter. The yellow dyes dyed the receiving layer of the recording material in the form of the image. Clear image recordings with no unevenness of the transfer were obtained.

The recorded images so obtained were irradiated with a 10,000 lux fluorescent lamp for a period of 14 days to investigate the stability of the colored image. Furthermore, the status A reflection density was measured before and after a test in which the images were stored in an incubator at 60° C. for a period of 7 days in order to investigate heat resistance, and the ratio of these values was used as a measure of the image stability. The results obtained are shown in Table. 1

TABLE 1

| No. | Dye Compound | Image Density immediately after Transfer | Image Stability: Irradiated with a Fluorescent Lamp | Image Stability: Stored at 60° C. |
|---|---|---|---|---|
| 1 | 1 | 1.05 | 0.80 | 0.99 |
| 2 | 2 | 1.03 | 0.79 | 0.98 |
| 3 | 3 | 1.10 | 0.81 | 0.99 |
| 4 | 4 | 1.05 | 0.78 | 0.97 |
| 5 | 8 | 1.07 | 0.82 | 0.98 |
| 6 | 12 | 1.02 | 0.80 | 0.99 |
| 7 | 15 | 0.95 | 0.79 | 0.98 |
| 8 | 18 | 1.04 | 0.77 | 0.96 |
| 9 | 20 | 0.90 | 0.75 | 0.95 |
| a | a | 1.01 | 0.70 | 0.86 |
| b | b | 1.03 | 0.50 | 0.93 |

Compound a

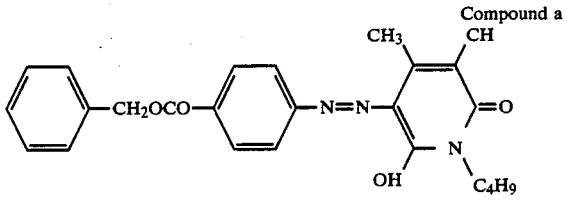

Compound b

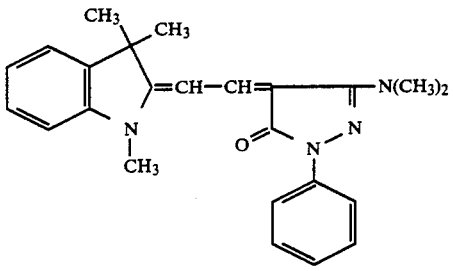

The dyes used in this invention clearly provided better image stability than comparative examples a and b.

EXAMPLE 2

Preparation of the Heat-Sensitive Transfer Material (10)

The substances in the composition indicated below were adequately mixed and dispersed to form a lubricating heat resistant protective-layer coating composition.

| Composition of the Coating Composition | |
|---|---|
| Methyl methacrylate | 10 g |
| n-Butyl acrylate | 2 g |
| Benzoyl peroxide | 0.1 g |
| Silica | 2.5 g |
| Toluene | 35 g |
| Iso-propyl alcohol (IPA) | 15 g |

A toluene/IPA mixture was added suitably to dilute this coating composition which was then coated with a wire bar onto a polyethyleneterephthalate film (referred to below as a PET film) of thickness 6 μm as a support and then dried at 100° C. for 1 minute, and a slip-type heat resistant protective layer of thickness about 1.5 μm was formed. Next, a thermal fusible ink of the composition indicated below was coated on the opposite side of the support to the above mentioned heat resistant protective layer.

| Composition of the Thermal Fusible Ink | |
|---|---|
| Dye (Compound No. 1) | 10 g |
| Lanolin fatty acid, barium salt | 30 g |
| Carnauba wax | 20 g |
| Paraffin wax | 20 g |
| Dispersing agent | 0.5 g |
| Liquid paraffin | 5 g |

The ink of the composition described above was thoroughly dispersed at 68° C. in a ball mill along with 100 ml of methyl ethyl ketone and 130 ml of toluene.

Next, 300 g of a 20 wt % vinyl chloride/vinyl acetate resin solution (10 parts resin, 20 parts toluene, and 20 parts methyl ethyl ketone) was added to the above mentioned ink dispersion and the mixture was dispersed in a ball mill for about 1 hour to provide a heat-sensitive transfer layer coating composition.

This coating composition was coated using a wire bar onto the opposite side of the PET film to the aforementioned lubricating heat resistant layer, and dried for 10 minutes at a drying temperature of 100 ° C. to form a heat-sensitive fusible transfer layer of thickness about 5 μm.

Printing were made in the same way as in Example 1 using the fusible type transfer material so obtained and a synthetic paper as the recording material, and bright yellow recordings were obtained. Furthermore, the recorded sheets were evaluated for image stability in the same way as in Example 1, and the results obtained indicated that the image stability was very high.

While the invention has been described in detail and with reference to specific examples thereof, it will be apparent to one skilled in the art that various changes and modifications can be made therein without departing from the spirit and scope thereof.

What is claimed is:

1. A heat-sensitive transfer material comprising a support having thereon a coloring material layer comprising at least one dye represented by formula (I):

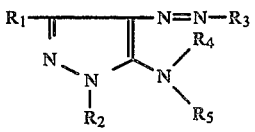

(I)

wherein $R_1$ represents a hydrogen atom, an alkyl group, an alkoxy group, an aryl group, an alkoxycarbonyl group, a cyano group or a carbamoyl group; $R_2$ represent a hydrogen atom, an alkyl group or an aryl group; $R_3$ represents an aryl group; and $R_4$ and $R_5$, which may be the same or different, each represents a hydrogen atom or an alkyl group.

2. A heat-sensitive transfer material as claimed in claim 1, wherein $R_1$ represents an alkyl group having from 1 to 4 carbon atoms; $R_2$ represents a methyl group or a phenyl group, $R_3$ represents a phenyl group having from 1 to 3 electron attractive groups; and $R_4$ and $R_5$ each represents a hydrogen atom.

3. A heat-sensitive transfer material as claimed in claim 1, wherein said coloring material layer comprises a binder resin and is a heat-sensitive sublimation transfer layer.

4. A heat-sensitive transfer material as claimed in claim 3, wherein the amount of said binder resin is from about 80 to 600 parts by weight per 100 parts by weight of said dye.

5. A heat-sensitive transfer material as claimed in claim 1, wherein said coloring material layer comprises a binder and is a heat-sensitive fusion transfer layer.

6. A heat-sensitive transfer material as claimed in claim 5, wherein the amount of said dye is from 10 to 65 wt % based on the total amount of said coloring material layer.

* * * * *